US005853501A

United States Patent [19]

Teraoka et al.

[11] Patent Number: 5,853,501

[45] Date of Patent: Dec. 29, 1998

[54] HOT ROLLED CR-NI STAINLESS STEEL PLATE OF LOW ANISOTROPY AND PROCESS FOR PRODUCING THE SAME

[75] Inventors: Shin-ichi Teraoka; Eiichiro Ishimaru, both of Hikari, Japan

[73] Assignee: Nippon Steel Corporation, Tokyo, Japan

[21] Appl. No.: 913,502

[22] PCT Filed: Jan. 16, 1997

[86] PCT No.: PCT/JP97/00067

§ 371 Date: Mar. 11, 1997

§ 102(e) Date: Mar. 11, 1997

[87] PCT Pub. No.: WO97/26378

PCT Pub. Date: Jul. 24, 1997

[30] Foreign Application Priority Data

Jan. 17, 1996 [JP] Japan ..... 8-006059

[51] Int. Cl.[6] ..... C22C 38/40; C21D 8/02

[52] U.S. Cl. ..... 148/327; 148/542

[58] Field of Search ..... 148/542, 327

[56] References Cited

U.S. PATENT DOCUMENTS 4,420,347 12/1983 Ueda et al. ..... 148/542
4,812,176 3/1989 Tanaka et al. .
4,824,491 4/1989 Tanaka et al. .

FOREIGN PATENT DOCUMENTS 63-421 6/1986 Japan .
1-240618 3/1988 Japan .
7-268460 10/1995 Japan .

*Primary Examiner*—Deborah Yee
*Attorney, Agent, or Firm*—Kenyon & Kenyon

[57] ABSTRACT

A low anisotropic Cr—Ni-based stainless steel hot-rolled sheet, which has texture with (100), (110), (111), (311) and (211) ND plane intensity from 0.5 to 1.5 in an inverse pole figure measured for a ¼ section of the sheet thickness, and which is produced by continuously casting molten Cr—Ni-based stainless steel into a cast strip with a thickness of 1.5 mm to 6 mm using a continuous casting machine wherein the mould walls move in synchronization with the cast strip, hot rolling it at a hot rolling temperature of 950°–1,150° C. and a reduction of 25 to 35% within 60 seconds after the cast strip has left the mould, and then performing heat treatment wherein the strip is held for 5 to 60 seconds in a temperature range of 950°–1,200° C.; as well as a process for its production.

2 Claims, 2 Drawing Sheets

HOT ROLLED CR-NI STAINLESS STEEL PLATE OF LOW ANISOTROPY AND PROCESS FOR PRODUCING THE SAME

TECHNICAL FIELD

The present invention provides a low anisotropic Cr—Ni-based stainless steel hot-rolled sheet and a process for its production.

BACKGROUND ART

A technique has been developed in recent years for obtaining cast strips with a thickness of 10 mm or less by direct casting from molten steel, and actual apparatuses therefor have been tested. With the new technique, it is possible to simplify or even eliminate the hot rolling process.

Conventionally, slabs with thicknesses of over 100 mm have required hot rolling with a hot rolling mill involving a large consumption of energy, and thus the advantages of simplifying or eliminating the hot rolling step include not only lowering of production costs, but also benefits from the standpoint of the environment. Hereunder, the process including the step of casting a thin strip with a thickness of 10 mm or less from molten steel will be referred to as the "new process", and the process including hot rolling a slab into a hot-rolled strip will be referred to as the "existing hot rolling process".

Conventionally, when Cr—Ni-based stainless steel hot-rolled annealed sheets, typically 18% Cr-8% Ni steel, are produced by the existing hot rolling process, a hot rolling reduction of about 98% or greater results in development of a strong hot rolling texture, and after annealing of the hot-rolled sheet the (100) [001] texture develops.

By casting of thin cast strips without the hot rolling step in the new process, it is possible to prevent formation of the (100) [001] texture which is a characteristic of hot-rolled annealed sheets, and thus produce a steel strip with low anisotropy. However, the resulting thin cast strip strongly develops a (100) [0vw] texture which is a characteristic of solidified structures.

Attempts have also been made to hot roll cast strips using the new process. For example, in Japanese Patent Application No. 61-141433, a Cr—Ni-based stainless steel cast strip is subjected to hot rolling at 800° C. or higher to a reduction of 50% or less followed by cold rolling to produce a thin sheet product, by which it is possible to produce a thin sheet with excellent surface quality; however, the anisotropy of such hot-rolled steel sheets had not been studied.

SUMMARY OF THE INVENTION

The present invention allows efficient production of Cr—Ni-based stainless steel hot-rolled strips with low anisotropy, which have been difficult to produce by conventional processes.

The present invention has the following construction which is designed to achieve the object described above.

The gist thereof is the provision of a low-anisotropic Cr—Ni-based hot-rolled stainless steel strip which has a texture with (100), (110), (111), (311) and (211) rolling plane normal direction (ND), which have an orientation intensity from 0.5 to 1.5 in an inverse pole figure as measured for a ¼ section of the sheet thickness, as well as a process for producing a low anisotropic Cr—Ni-based hot-rolled stainless steel sheet by continuously casting Cr—Ni-based stainless molten steel into a cast strip with a thickness of 1.5 mm to 6 mm using a continuous casting machine wherein the mould walls move in synchronization with the cast strip, hot rolling it in a temperature range of 950°–1,150° C. within 60 seconds after the cast strip has left the mould at a reduction of 25 to 35% to make a hot-rolled strip, and then performing heat treatment wherein the hot-rolled strip is held for 5 to 60 seconds in a temperature range of 950°–1,200° C.

THE MOST PREFERRED EMBODIMENTS

Figure 1:
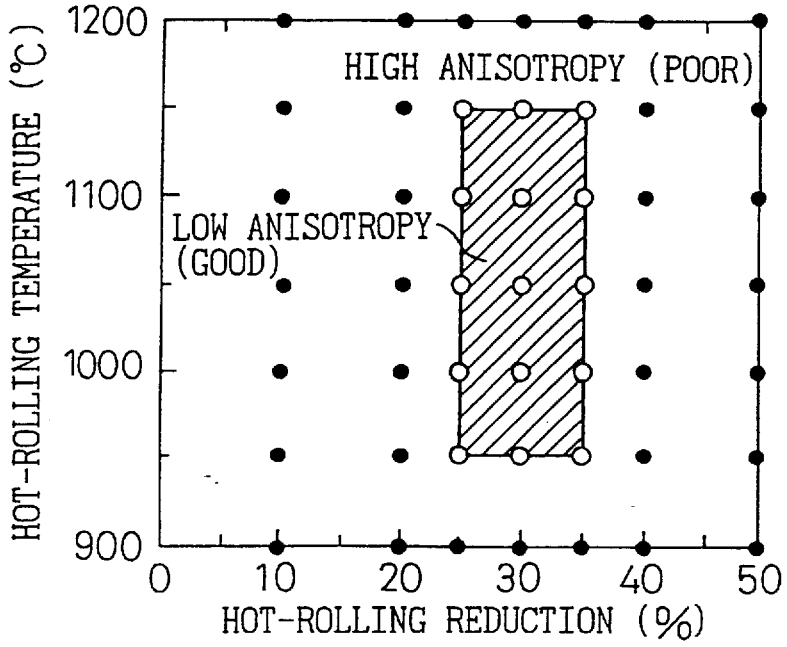
FIG. 1 is a graph showing the influence on the anisotropy of a hot-rolled annealed sheet of the hot rolling temperature and the hot rolling reduction of a cast strip.

In the existing hot rolling process, the high hot rolling reduction rate results in development of a {110} (112) texture in the hot-rolled sheet, which is the hot rolling texture with a typical of FCC metal. Upon annealing of the hot-rolled sheet, there is a large amount of accumulated dislocation and the inclusions and precipitates which inhibit the growth of the recrystallized grains are coarse and thus have a weaker ability to inhibit the grain growth; therefore, the recrystallized grains grow relatively easily and form a recrystallized structure with a strongly developed {100} (001) texture.

On the other hand, hot rolling of a cast sheet produced by the new process results in destruction of the {100} (0vw) texture developed in the cast strip, which is the relatively random texture in the hot-rolling direction, and development of a {110} (112) texture; however, it becomes possible to suppress the development of the rolling texture by setting the hot rolling conditions and annealing conditions to within specific ranges. It is also possible to control the growth of the recrystallized grains by controlling the hot rolling conditions.

In other words, by hot rolling with the hot rolling temperature and reduction within specific ranges, the development of the hot rolling texture {110} (112) orientation is suppressed, allowing the texture after hot rolling to be an texture wherein the {100} (0vw) orientation is slightly inclined toward the rolling direction.

Also, further control of the cast-strip temperature from casting to hot rolling can be used to control the growth of the recrystallized grains. By annealing a hot-rolled sheet which has an texture with the {100} (0vw) orientation slightly tilted in the rolling direction and with controlled deposits to suppress growth of the recrystallized grains, there is obtained a hot-rolled annealed sheet with minimized development of the texture of {100} (001), {112} (113), {113} (332), etc. which strongly develop in conventional hot-rolled annealed sheets, and having recrystallized grains with relatively random crystal orientation in ND as well as in the rolling direction (RD).

It is possible to control the growth of the recrystallized grains by controlling the temperature of the cast strip from casting to hot rolling because this controls the precipitation state of the precipitates such as MnS, which are precipitated in a relatively high temperature range immediately after solidification.

The reason for restricting the structural aspects of the present invention will now be explained.

The steel used was Cr—Ni-based stainless steel, which is typically 18% Cr-8% Ni steel. Common carbon steel or Cr-based stainless steel also has a different texture forming mechanism than Cr—Ni-based stainless steel, and cannot be used to produce low-anisotropic hot-rolled steel sheets by the process of the present invention.

The reason for a cast strip thickness of 6 mm or less is to obtain a sheet thickness which is commonly used for hot-rolled steel sheets, with the reduction of hot rolling according to the invention. Also, the reason for a cast strip thickness of 1.5 mm or greater is that a cast strip thickness results in a greater proportion of crystal orientation other than {100} (0vw) in the cast strip texture by the influence of chilled crystals in the cast strip surface layer, making it impossible to obtain a hot-rolled steel sheet with low anisotropy. The preferred sheet thickness is 2 to 5 mm.

The time from when the cast strip leaves the drum until it enters the hot rolling mill for hot rolling is limited to 60 seconds or less in order to control the precipitate distribution of the cast strip. Hot rolling before sufficient growth of precipitates in the cast strip introduces considerable displacement to form precipitation sites of those precipitates. If the time until hot rolling is over 60 seconds, the precipitates begin to grow prior to hot rolling. These precipitation sites become frozen vacancies which are formed by rapid cooling and solidification, and grain boundaries of the solidified grains. When a hot-rolled sheet with this precipitate distribution is annealed, a recrystallized texture develops, preventing formation of a low-anisotropic hot-rolled steel sheet. The preferred range is from 20 to 40 seconds.

Here, the high or low anisotropy of the hot-rolled annealed sheet is defined such that a low-anisotropic material is one with (100), (110), (111), (311) and (211) ND intensity, which are typical crystal orientations, in a range of 0.5 to 1.5 times with respect to the randomly oriented material.

The hot rolling temperature and the hot rolling reduction for the cast strips were determined by the following experiment. Specifically, type304 thin cast sheets with a sheet thickness of 4.3 mm were cast in a laboratory, and 60 seconds after casting they were hot-rolled at different hot rolling temperatures and hot-rolling reduction, and then annealed for 20 seconds at 1,100° C., upon which the texture were observed.

As shown in FIG. 1, when the hot rolling temperatures and hot rolling reduction rates exceed the ranges according to the invention, it is impossible to build an texture with the {100} (0vw) orientations slightly tilted toward the rolling direction, and therefore the annealing texture have poor anisotropy.

Figure 2:
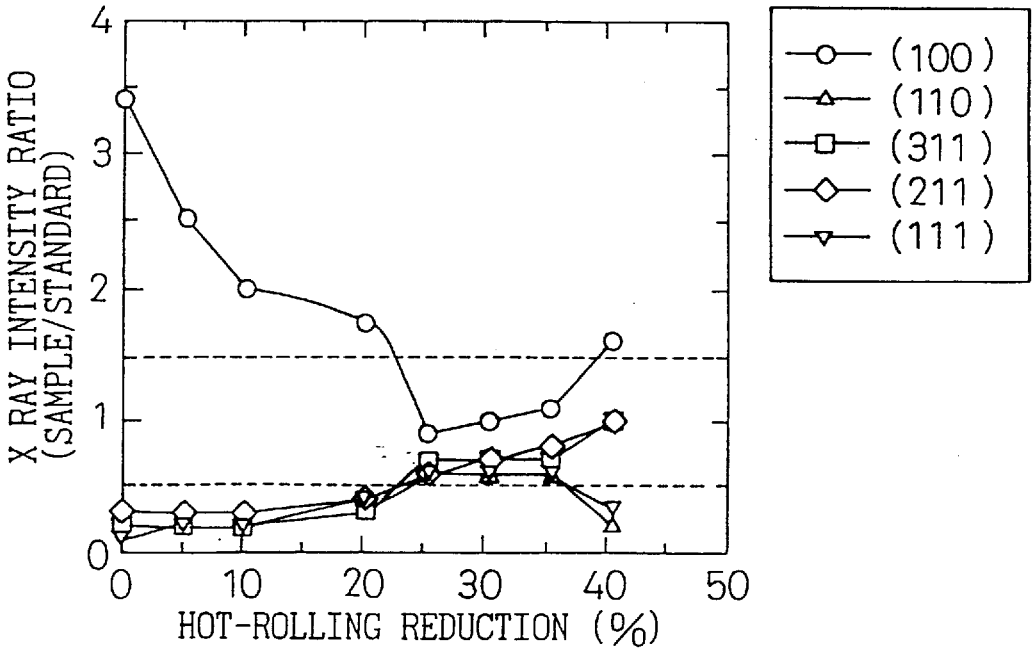
FIG. 2 is a graph showing the details of the influence on the respective crystal orientations of a hot-rolled annealed sheet of the hot rolling reduction rate during hot rolling of a cast strip.

FIG. 2 shows the relationship between the hot rolling reduction and the crystal orientation of a hot-rolled annealed sheet at a hot rolling temperature of 1,100° C. It is seen that the {100} (0vw) orientation developed in the cast strip is reduced as the reduction rate increases, becoming minimal in a reduction range of 25 to 35%, thus giving a nearly random texture. When the reduction increases further, the rolling texture develops thus developing {100}, {110}, etc., and this results in poor anisotropy. The preferred range is a hot rolling temperature of 980° C. to 1,140° C. and a hot rolling reduction of 28%–32%.

Figure 3:
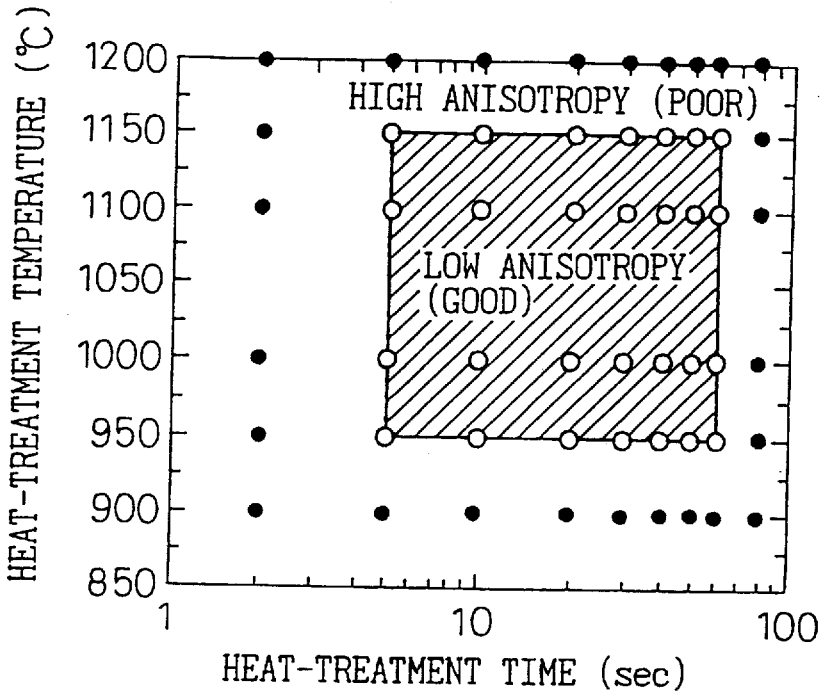
FIG. 3 is a graph showing the influence on anisotropy of a hot-rolled annealed sheet of the annealing conditions during annealing, after hot rolling of a cast strip.

A similar experiment was used for the annealing conditions after hot rolling. Specifically, type304 cast strips with a sheet thickness of 4.3 mm were cast in a laboratory, and 30 seconds after casting they were hot-rolled at 1,100° C. with a reduction of 30%, and then annealed under different conditions. FIG. 3 shows the relationship between the textures of the hot-rolled annealed sheets and the annealing conditions. Poor anisotropy resulted with annealing conditions outside of the range of the invention.

The reason for satisfactory anisotropy within the range of the invention is that the rolling texture disappears during the growth process of the recrystallized grains, inhibiting growth of the recrystallized grains during the process of formation of the recrystallization texture with a timing at which the crystal orientation is most nearly random. The preferred annealing conditions are an annealing temperature of 1,000°–1,150° C. for 5–10 seconds.

After the hot rolling and annealing, coiling is preferably accomplished at a temperature of 600° C. or below to prevent sensitization of the hot-rolled sheet. Acid pickling in a sensitized state results in over pickling of the grain boundary and thus impairs the surface quality.

The coiling temperature after the heat treatment is preferably 600° C. or below.

The present invention will now be described in detail with reference to the following examples that by no means limit the scope of the invention.

EXAMPLES

Example 1

The Cr—Ni-based stainless steels listed in Table 1 were melted and used to make cast strips with a thickness of 1.5 to 6 mm using an internally water-cooled vertical twin drum-type continuous casting machine. The cast strips were subjected to hot rolling with an insulated looper while varying the time until entering the hot rolling mill in a range of 5 to 60 seconds and varying the hot rolling temperature from 950° C. to 1,150° C., with hot rolling reduction rates in a range of 25% to 35%. After the hot rolling, the sheets were passed through a heat treatment furnace for annealing from 1,000° C. to 1,150° C. for 5 to 60 seconds. The annealing was followed by mist cooling and coiling at 500° C. The texture of the hot-rolled annealed sheets were determined by inverse pole figures for a ¼ section of the sheet thickness, and satisfactory anisotropy was considered to be (100), (110), (111), (112) and (113) ND plane orientation intensity of 0.5 to 1.5.

Comparison materials were prepared with times until hot rolling, and hot rolling conditions and heat treatment conditions after hot rolling which were outside of the ranges according to the invention, and these were used to evaluate the anisotropy of the hot-rolled annealed sheets.

As shown in Table 1, the hot-rolled annealed sheets produced by the process of the invention had low anisotropy, while the comparison materials had poor anisotropy.

TABLE 1

(Process of the invention)

| No. | Type of steel | Cast strip thickness (mm) | Time from casting to hot rolling | Hot rolling conditions Temperature (%) | Hot rolling conditions Reduction (%) | Heat treatment conditions after hot rolling Temperature (%) | Heat treatment conditions after hot rolling Time (sec) | Evaluation of anisotropy |
|---|---|---|---|---|---|---|---|---|
| 1 | Type 304 | 4.3 | 10 | 1100 | 30 | 1100 | 10 | good |
| 2 | Type 301 | 4.3 | 10 | 1100 | 30 | 1100 | 10 | good |
| 3 | Type 305 | 4.3 | 10 | 1100 | 30 | 1100 | 10 | good |
| 4 | Type 308 | 4.3 | 10 | 1100 | 30 | 1100 | 10 | good |
| 5 | Type 309 | 4.3 | 10 | 1100 | 30 | 1100 | 10 | good |
| 6 | Type 310 | 4.3 | 10 | 1100 | 30 | 1100 | 10 | good |
| 7 | Type 316 | 4.3 | 10 | 1100 | 30 | 1100 | 10 | good |
| 8 | Type 304 | 3 | 10 | 1100 | 30 | 1100 | 10 | good |
| 9 | Type 304 | 5 | 10 | 1100 | 30 | 1100 | 10 | good |
| 10 | Type 304 | 6 | 10 | 1100 | 30 | 1100 | 10 | good |
| 11 | Type 304 | 4.3 | 10 | 1100 | 30 | 1100 | 10 | good |
| 12 | Type 304 | 4.3 | 5 | 1100 | 30 | 1100 | 10 | good |
| 13 | Type 304 | 4.3 | 20 | 1100 | 30 | 1100 | 10 | good |
| 14 | Type 304 | 4.3 | 60 | 1100 | 30 | 1100 | 10 | good |
| 15 | Type 304 | 4.3 | 10 | 950 | 30 | 1100 | 10 | good |
| 16 | Type 304 | 4.3 | 10 | 1000 | 30 | 1100 | 10 | good |
| 17 | Type 304 | 4.3 | 10 | 1150 | 30 | 1100 | 10 | good |
| 18 | Type 304 | 4.3 | 10 | 1100 | 25 | 1100 | 10 | good |
| 19 | Type 304 | 4.3 | 10 | 1100 | 35 | 1100 | 10 | good |
| 20 | Type 304 | 4.3 | 10 | 1100 | 30 | 950 | 10 | good |
| 21 | Type 304 | 4.3 | 10 | 1100 | 30 | 1000 | 10 | good |
| 22 | Type 304 | 4.3 | 10 | 1100 | 30 | 1200 | 10 | good |
| 23 | Type 304 | 4.3 | 10 | 1100 | 30 | 1100 | 5 | good |
| 24 | Type 304 | 4.3 | 10 | 1100 | 30 | 1100 | 20 | good |
| 25 | Type 304 | 4.3 | 10 | 1100 | 30 | 1100 | 60 | good |

TABLE 2

(Comparison process)

| No. | Type of steel | Cast strip thickness (mm) | Time from casting to hot rolling | Hot rolling conditions Temperature (%) | Hot rolling conditions Reduction (%) | Heat treatment conditions after hot rolling Temperature (%) | Heat treatment conditions after hot rolling Time (sec) | Evaluation of anisotropy |
|---|---|---|---|---|---|---|---|---|
| 26 | Type 304 | 1.3 | 10 | 1100 | 30 | 1100 | 10 | poor |
| 27 | Type 304 | 6.5 | 10 | 1100 | 30 | 1100 | 10 | poor |
| 28 | Type 304 | 4.3 | 70 | 1100 | 30 | 1100 | 10 | poor |
| 29 | Type 304 | 4.3 | 10 | 900 | 30 | 1100 | 10 | poor |
| 30 | Type 304 | 4.3 | 10 | 1200 | 30 | 1100 | 10 | poor |
| 31 | Type 304 | 4.3 | 10 | 1100 | 20 | 1100 | 10 | poor |
| 32 | Type 304 | 4.3 | 10 | 1100 | 40 | 1100 | 10 | poor |
| 33 | Type 304 | 4.3 | 10 | 1100 | 30 | 900 | 10 | poor |
| 34 | Type 304 | 5 | 10 | 1100 | 30 | 1220 | 10 | poor |

INDUSTRIAL AVAILABILITY

The present invention provides a low anisotropic Cr—Ni-based stainless steel hot-rolled sheet and a process for its production. In addition, the present invention achieves industrially extremely excellent effects in this technical field.

We claim:

1. A low anisotropic Cr—Ni-based stainless steel hot-rolled sheet, which has a texture with (100), (110), (111), (311) and (211) ND plane intensity from 0.5 to 1.5 in an inverse pole figure measured for a ¼ section of the sheet thickness.

2. A process for producing a low anisotropic Cr—Ni-based stainless steel hot-rolled steel sheet, characterized by continuously casting Cr—Ni-based stainless molten steel into a cast strip with a sheet thickness of 1.5 mm to 6 mm using a continuous casting machine wherein the mould walls move in synchronization with the cast strip, hot rolling it in a temperature range of 950°–1,150° C. within 60 seconds after the cast strip has left the mould with a reduction of 25 to 35% to make a hot-rolled strip, and then performing heat treatment wherein the hot-rolled strip is held for 5 to 60 seconds in a temperature range of 950°–1,200° C.

* * * * *